US006546841B2

(12) United States Patent
Kato et al.

(10) Patent No.: US 6,546,841 B2
(45) Date of Patent: Apr. 15, 2003

(54) SWASH PLATE COMPRESSOR AND PISTON THEREFOR

(75) Inventors: Takayuki Kato, Aichi-ken (JP); Seiji Katayama, Aichi-ken (JP); Takahiro Hoshida, Aichi-ken (JP); Fuminobu Enokijima, Aichi-ken (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/801,388

(22) Filed: Mar. 8, 2001

(65) Prior Publication Data

US 2001/0022132 A1 Sep. 20, 2001

(30) Foreign Application Priority Data

Mar. 17, 2000 (JP) ..... 2000-076013

(51) Int. Cl.[7] ..... F04B 27/08
(52) U.S. Cl. ..... 92/71; 92/165 PR
(58) Field of Search ..... 92/12.2, 71, 165 PR

(56) References Cited

U.S. PATENT DOCUMENTS 5,382,139 A * 1/1995 Kawaguchi et al. ..... 417/269
5,615,599 A * 4/1997 Terauchi ..... 92/165 PR
5,934,172 A * 8/1999 Terauchi ..... 92/165 PR
6,095,761 A 8/2000 Kanai et al. ..... 417/269
6,123,513 A 9/2000 Hiramatsu et al. ..... 417/222.2

FOREIGN PATENT DOCUMENTS

JP 06-346844 12/1994

* cited by examiner

*Primary Examiner*—Edward K. Look
*Assistant Examiner*—Thomas E. Lazo
(74) *Attorney, Agent, or Firm*—Woodcock Washburn LLP

(57) ABSTRACT

A piston includes an engagement portion that engages with a swash plate. The engagement portion is provided with a pair of arm portions and a coupling portion for coupling base ends of the arm portions each other. An axial rib extending in the axial direction is integrally provided in a central part of a back surface of the coupling portion in the width direction orthogonal to a central axis of a head portion of the piston. An accommodation groove is formed on an inner circumferential surface of a cylinder bore corresponding to the axial rib, such that the axial rib does not interfere with the cylinder bore when the piston moves to the top dead center.

10 Claims, 4 Drawing Sheets

SWASH PLATE COMPRESSOR AND PISTON THEREFOR

BACKGROUND OF THE INVENTION

1. Field of the Invention

The present invention relates to a swash plate compressor and a piston therefor.

2. Description of the Related Art

A piston of a swash plate compressor is provided with an engagement portion for engaging with a swash plate. The engagement portion is typically provided with a pair of arm portions extending in parallel to each other and a coupling portion for coupling base ends of the arm portions each other. The coupling portion crosses over an outer circumference part of the swash plate, and the pair of arms engage with both surfaces of the swash plate via shoes, respectively. The coupling portion of the engagement portion receives bending moment when the swash plate compressor is activated. The piston is provided with an engagement portion and a head portion integrally. When the swash plate compressor is activated, the head portion reciprocatingly moves within a cylinder bore. Then, a force acts in the direction of forcing one of the pair of arm portions to move away from the other based on an inertial force acting on the head portion and a frictional force between an outer circumferential surface of the head portion and an inner circumferential surface of the cylinder bore, and bending moment acts in the direction of bending the coupling portion convexly toward the swash plate side.

The bending moment repeatedly acts a large number of times, which tends to cause fatigue fracture in the engagement portion, and therefore is a factor behind the decrease of durability of the piston. In order to improve the durability, it is sufficient to increase bending strength of the coupling portion. However, an attempt to increase the bending strength makes the piston heavier, and requirement of lightening the piston cannot be satisfied.

In addition, in order to increase the bending strength of the coupling portion, it is necessary to make a section modulus of a transverse section shape of the coupling portion larger. For this purpose, it is effective to make the coupling portion thicker. However, since the coupling portion is for coupling the pair of arm portions through a space between an outer circumferential surface of the swash plate and an inner circumferential surface of a housing, it is necessary to either making a diameter of the swash plate smaller or making a diameter of the housing larger to make the coupling portion thicker, both of which are not preferable.

SUMMARY OF THE INVENTION

The present invention has been devised in view of the above and other drawbacks, and it is an object of the present invention to provide a swash plate compressor and a piston therefor that are capable of at least one of increasing bending strength of a coupling portion to be increased while avoiding increasing weight of the piston as much as possible, and increasing a section modulus of the coupling portion without necessitating decrease of a diameter of a swash plate and increase of a diameter of a housing.

A piston for a swash plate compressor in accordance with the present invention is provided with a head portion to be fitted in a cylinder bore and an engagement portion, integrally formed with the head portion, which has a pair of arm portions and a coupling portion for coupling base ends of the arm portions each other and engages with a swash plate while crossing over a circumference part of the swash plate. The engagement portion is provided with a protruding portion that protrudes radially outwardly from a back surface on the opposite side of a swash plate side of the coupling portion.

The protruding portion may include an axial rib extending in a direction parallel to a central axis of the head portion on the back surface on the opposite side of the swash plate side of the coupling portion.

In addition, a swash plate compressor in accordance with the present invention is provided with the above-mentioned piston for a swash plate compressor, a housing having a cylinder bore which is fitted in the head portion of the piston and forms an accommodating recess capable of accommodating the protruding portion on the inner circumferential surface, and a swash plate for reciprocatingly moving the piston by converting its rotational motion about a rotation axis into the reciprocating motion of the piston while engaging with the engagement portion and inclining with respect to the rotation axis.

DETAILED DESCRIPTION OF THE PREFERRED EMBODIMENTS

An example of a swash-plate compressor which is used in an automotive air conditioning device and constitutes an embodiment of the present invention, will be described with reference to the accompanying drawings.

Figure 1:
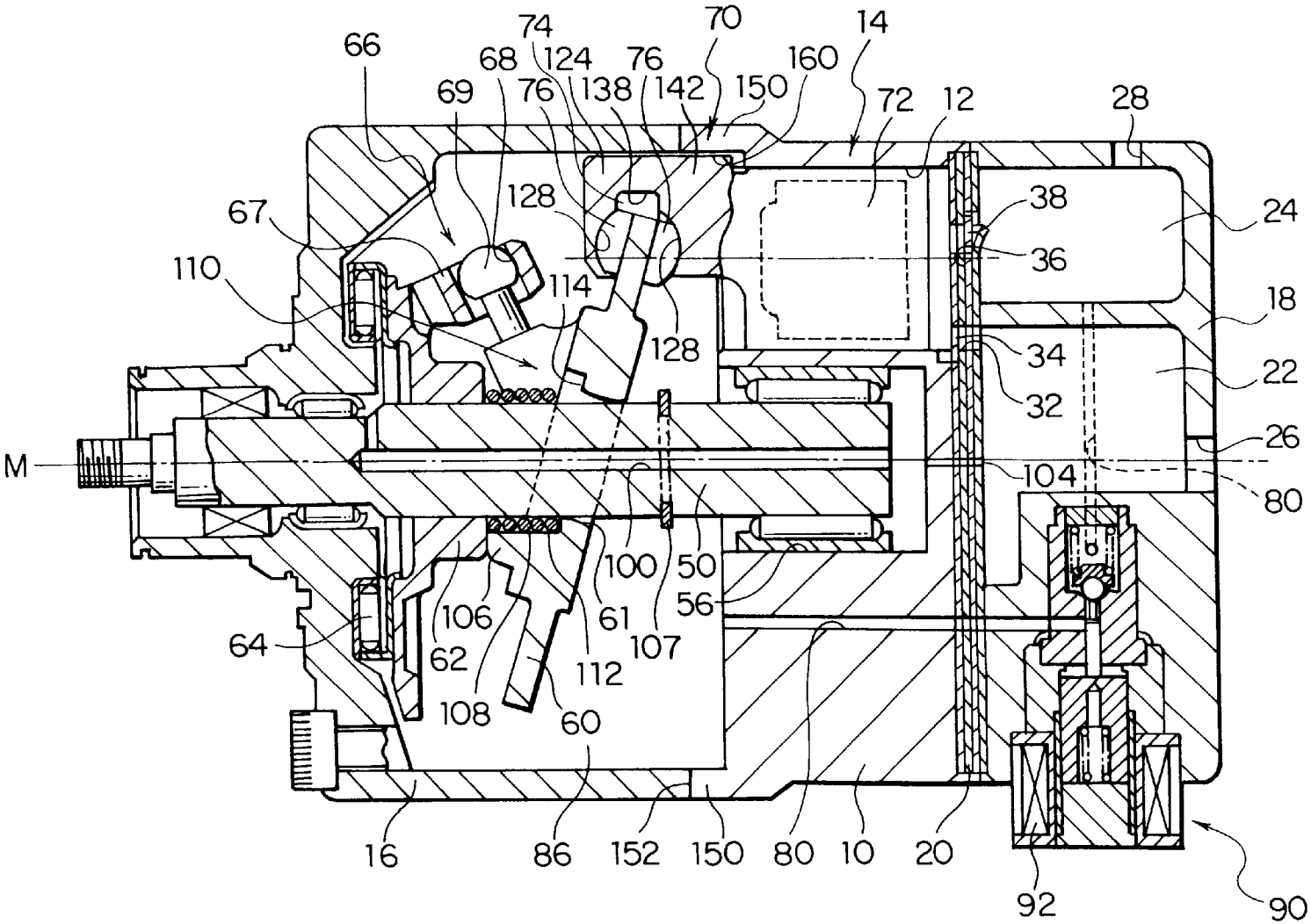
FIG. 1 is a front sectional view showing a swash plate compressor in accordance with an embodiment of the present invention.
Figure 2:
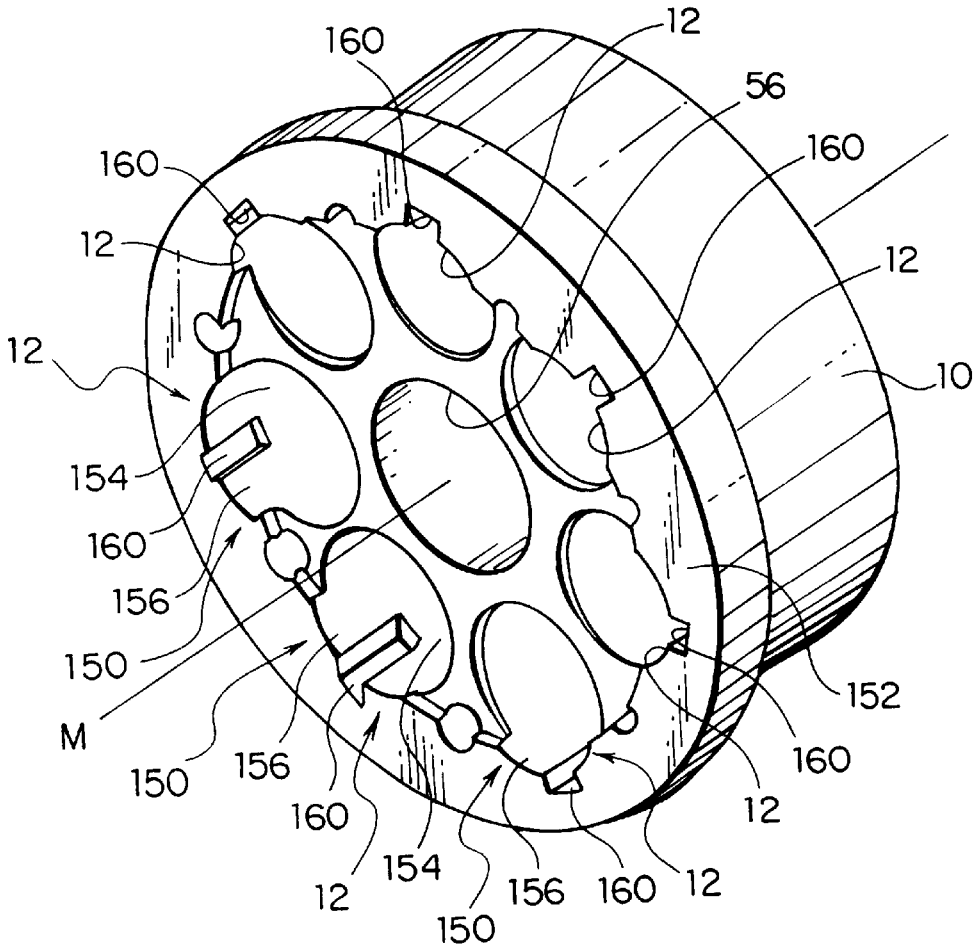
FIG. 2 is a perspective view showing a cylinder block of the swash plate compressor of FIG. 1.

FIGS. 1 and 2 show a swash-plate compressor according to the present embodiment. In FIG. 1, a reference numeral 10 denotes a cylinder block. A plurality of cylinder bores 12 (seven in the example figures) are disposed at an equal angular interval on a circumference about a central axis M of the cylinder block 10, and the central axis of the cylinder bores extend parallel to the central axis M. In each of the cylinder bores 12, a single-headed piston 14 (hereafter referred to simply as a piston 14) is disposed to make a reciprocating motion. A front housing 16 is attached to one end surface of the cylinder block 10 in the axial direction (i.e. the left side end surface in FIG. 1, referred to as a front end surface), and a rear housing 18 is attached via a valve plate 20 to the other end surface (the right side end surface in FIG. 1, referred to as a rear end surface). The front housing 16, the rear housing 18, the cylinder block 10 constitute a housing assembly of the swash-plate compressor. A suction chamber 22 and a discharge chamber 24 are defined between the rear housing 18 and the valve plate 20, which are respectively connected through an inlet 26 and a outlet 28 to a refrigerating circuit not shown. The valve plate 20 is provided with suction ports 32, suction valves 34, discharge ports 36, discharge valves 38 and the like.

A rotary shaft 50 is rotatably provided to extend on and along a rotation axis, which is the central axis M of the cylinder block 10. The rotary shaft 50 is supported at its ends through bearings to the front housing 16 and the cylinder block 10. A central support hole 56 is formed through a central portion of the cylinder block 10, and the rotary shaft 50 is supported to the central support hole 56. The front housing 16 side end portion of the rotary shaft 50 is connected via a clutch mechanism such as an electromagnetic clutch to an unillustrated automotive engine serving as an external drive source. Therefore, when the engine is started to connect the rotary shaft 50 to the engine through the clutch mechanism, the rotary shaft 50 per se is rotated about its own axis.

A swash plate 60 is attached to the rotary shaft 50 relatively movably in the axial direction and inclinably. The swash plate 60 is formed with a central through hole 61 passing through the central line, and the rotary shaft 50 is allowed to penetrate the central through hole 61. The central hole 61 has a gradually increasing diameter at each open end thereof. A rotary disk 62, serving as a rotation transmitting member, is fixed to the rotary shaft 50, and engaged with the front housing 16 via a thrust bearing 64. By a hinge mechanism 66, the swash plate 60 is rotated integrally with the rotary shaft 50, and permitted to be inclined along with the axial movement thereof. The hinge mechanism 66 includes a pair of support arms 67 fixedly provided to the rotary disk 62, a pair of guide pins 69 fixedly provided to the swash plate 60 and slidably fitted to a pair of guide holes 68 of the respective support arms 67, the central hole 61 of the swash plate 60, and an outer circumferential surface of the rotary shaft 50. In the present embodiment, the rotary shaft 50, the hinge mechanism 66 constituting the rotation transmitting device, etc. contribute a swash plate driving device. The swash plate driving device and the swash plate 60 contribute a reciprocating drive device for reciprocatingly moving the piston 14.

The piston 14 is designed as a hollow piston, and includes an engagement portion 70 for engagement with the swash plate 60, and a hollow head portion 72 provided integrally with the engagement portion 70 and fitted into the cylinder bore 12. The swash plate 60 is engaged with a groove 74 formed in the engagement portion 70 through a pair of semi-spherical shoes 76. The semi-spherical shoes 76 have spherical portions slidably held by the engagement portion 70, and planar portions that are contacted with the respective surfaces of the swash plate 60 to slidably hold and clamp the outer circumferential portion of the swash plate 60 therebetween. The shape of the piston 14 will be described in detail later.

The rotational motion of the swash plate 60 is converted, through the shoes 76, into the linear reciprocating motion of the piston 14. During the suction process in which the piston 14 is moved from an upper dead center to a lower dead center, the refrigerant gas within the suction chamber 22 is sucked via the suction port 32 and the suction valve 34 into the cylinder bore 12. During the compression process in which the piston 14 is moved from the lower dead center to the upper dead center, the refrigerant gas in the cylinder bore 12 is compressed and then discharged via the discharge port 36 and the discharge valve 38 to the discharge chamber 24. In association with the compression of the refrigerant gas, the axial compression reaction force acts on the piston 14. The compression reaction force is received through the piston 14, the swash plate 60, the rotary plate 62 and the thrust bearing 64 by the front housing 16. The engagement portion 70 of the piston 14 is provided with a rotation regulating portion 78 (see FIG. 3) integrally. The rotation regulating portion 78, when contacted with the inner circumferential surface of the front housing 16, restricts the rotation of the piston 14 about the central axis to avoid the interference between the piston 14 and the swash plate 60. The shape of the rotation regulating portion 78 will be described in detail later.

A supply passage 80 is provided to penetrate through the cylinder block 10. By this supply passage 80, the discharge chamber 24 is connected to a swash plate chamber 86 formed between the front housing 16 and the cylinder block 10. A capacity control valve 90 is provided at a midway of the supply passage 80. The capacity control valve 90 is an electromagnetic valve, and a solenoid 92 is energized and de-energized by a control device (not shown) mainly constructed by a computer. Depending on information of the cooling load, etc., the supplied current value is controlled, to thereby adjust the opening degree of the capacity control valve 90.

A bleeding passage 100 is provided in the interior of the rotary shaft 50. The bleeding passage 100 is opened to the central support hole 56 at one end thereof, and opened to the swash plate chamber 86 at the other end thereof. The central support hole 56 is communicated via a communication bore 104 with the suction chamber 22.

The swash-plate compressor according to the present embodiment is designed as a variable capacity type, and uses the discharge chamber 24 and the suction chamber 22 as a high pressure source and a low pressure source, respectively, so that a pressure difference therebetween is utilized to control the pressure within the swash plate chamber 86. This adjusts a pressure difference between the pressure in the cylinder bore 12 serving as the compression chamber and the pressure in the swash plate chamber 86, which are respectively acting on the front and rear of the piston 14, to thereby change an inclined angle of the swash plate 60, change the stroke of the piston 14 and adjust the discharge capacity of the compressor. More specifically, under the control of the capacity control valve 90, the swash plate chamber 86 is selectively communicated with and isolated from the discharge chamber 24 so that the pressure in the swash plate chamber 86 is controlled. In the de-energizing state of the solenoid 92, the capacity control valve 90 is fully opened so that the supply passage 80 is put into a communicated state, in which the high pressure refrigerant gas in the discharge chamber 24 is supplied to the swash plate chamber 86. Accordingly, the pressure within the swash plate chamber 86 is higher and thus the inclined angle of the swash plate 60 is minimal. When the inclined angle of the swash plate 60 is minimal, the volume varying ratio of the compression chamber by the piston 14, which is reciprocatingly moved in association with the rotation of the swash plate 60, is small, and thus the discharge capacity of the compressor is minimal. In the energizing state of the solenoid 92, as the opening degree of the capacity control valve 90 is smaller (including zero) by increasing the supplied current value, the supplied quantity of the high pressure refrigerant gas in the discharge chamber 24 to the swash plate chamber 86 is smaller, and the refrigerant gas within the swash plate chamber 86 is released via the bleeding passage 100 and the communication bore 104 to the suction chamber 22. Accordingly, the pressure in the swash plate chamber 86 is reduced. In association therewith, the inclined angle of the swash plate 60 is made larger to increase the volume varying ratio of the compression chamber by the piston 14, thereby increasing the discharge capacity of the compressor. When the supply passage 80 is interrupted due to the energizing of the solenoid 92, the high pressure refrigerant gas in the discharge chamber 24 is not supplied to the swash plate chamber 86, so that the inclined angle of the swash plate 60 is maximum. Accordingly, the discharge capacity of the compressor becomes maximum. The maximum inclined angle of the swash plate 60 is defined by the contact of a stopper 106 provided to the swash plate 60 with the rotary plate 62, and the minimal inclined angle is defined by the contact of the swash plate 60 with a stopper 107 provided onto the rotary shaft 50. The supply passage 80, the swash plate chamber 86, the capacity control valve 90, the bleeding passage 100, the communication bore 104, the control device, etc. constitute an swash plate inclination control device or a discharge capacity control device.

Between the swash plate 60 and the rotary plate 62, a compression coil spring 108 is disposed as an elastic member that is a kind of a biasing device, and the swash plate 60 is biased toward a position in which the swash plate 60 abuts the stopper 107 to take a posture substantially perpendicular to the central axis M of the cylinder block 10. When operation of the compressor is stopped, the swash plate 60 is caused to abut the stopper 107 by a biasing force of the spring 108, and put in a state for standing by for re-activation. At the end on the rotary plate 62 side of the central hole 61 of the swash plate 60, a recess 110 is formed with a diameter larger than the outer diameter of the central holes 61. When the swash plate 60 is inclined to a maximum angle of inclination, an end of the spring 108 is received in a receiving surface 112 of the recess 110 which is perpendicular to the central axis M, and when the swash plate 60 is inclined to a minimum angle of inclination, the end of the spring 108 is received in a receiving surface 114 of the recess 110 which is perpendicular to the central axis M.

The cylinder block 10 and the piston 14 is made of an aluminum alloy that is a kind of metal, and fluorocarbon resin coating is applied to the outer circumferential surface of the piston 14. When coasted with a fluorocarbon resin, a clearance between the piston 14 and the cylinder bore 12 can be as narrow as possible while preventing seizure by avoiding direct contact with a similar kind metal. Further, the cylinder block 10 and the piston 14 are preferably those of aluminum silicon series alloy. However, materials of the cylinder block 10 and the piston 14, materials for a coating layer and the like are not limited to the above-mentioned materials, but may be any other materials.

The piston 14 will be described more in detail.

Figure 4:
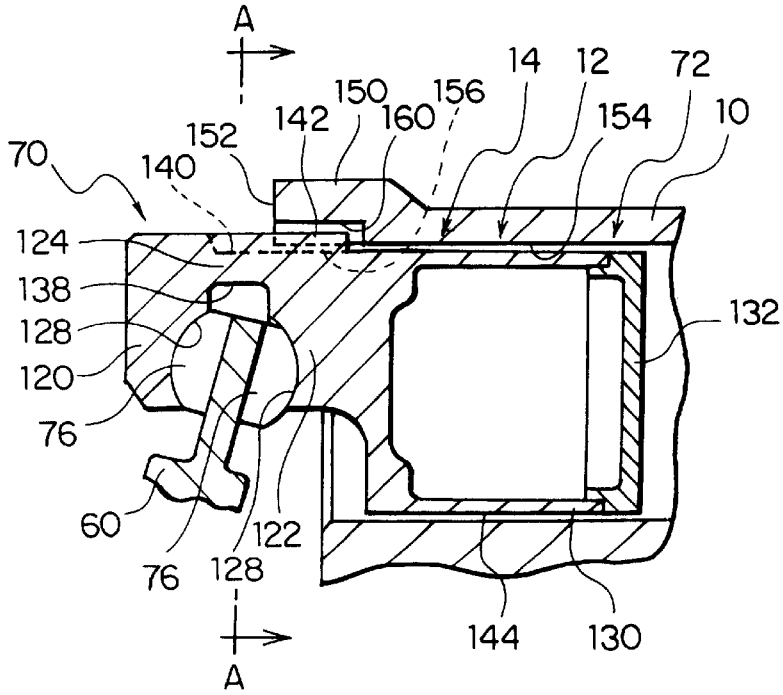
FIG. 4 is a front sectional view showing a structure around the piston of FIG. 1.

An end of the engagement portion 70 of the piston 14 on a side distant from the head portion 72 is generally formed in U shape by the formation of the groove as shown in FIG. 4, and is provided with a pair of arm portions 120 and 122 extending in the direction perpendicular to the central axis of the head portion 72 of the piston 14 and a coupling section 124 for coupling base ends of the arm portions 120 and 122. Recesses 128 are formed on opposing sides of the arm portions 120 and 122, respectively. Inner surfaces of the recesses 128 are formed in a concave spherical surface shape. The pair of shoes 76 contact both the front and back sides of the outer circumference part of the swash plate 60, and hold the swash plate 60 and, at the same time, are retained by the recesses 128. The head portion 72 is made as a hollow head portion provided with a bottomed cylindrical portion 130 that opens at one end and a closure member 132 for closing an opening of the bottomed cylindrical portion 130, thereby reducing weight. The cylindrical portion 130 configuring a main part of the head portion 72 is formed integrally with the arm portion 122 side of the engagement portion 70 as its bottom wall part.

Figure 3:
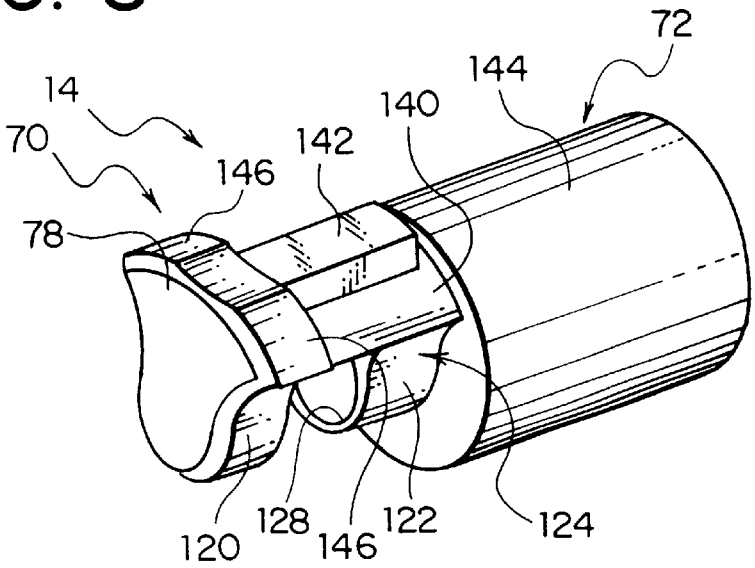
FIG. 3 is a perspective view showing a piston of the swash plate compressor of FIG. 1.
Figure 5:
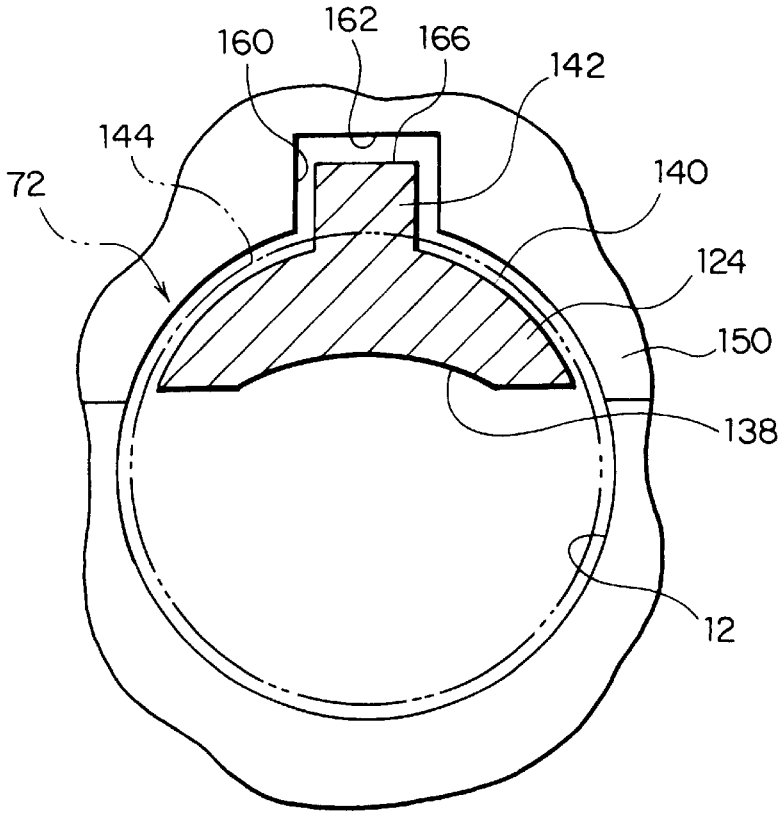
FIG. 5 is a sectional view taken away on the line A—A of FIG. 4.

As shown in FIG. 5, an inner surface 138 on a side of the coupling portion 124 of the piston 14 with which the swash plate 60 is engaged and a back surface 140 of the other side are both formed as partially cylindrical surfaces that are convex outwardly in the radial direction. An axial rib 142 extending in parallel to the central axis of the head portion 72 is integrally provided in a central part in the width direction orthogonal with the axial direction of the back surface 140. The coupling portion 124 is reinforced by the axial rib 142. The axial rib 142 has a transverse sectional shape formed in rectangular smaller than the width of the coupling portion 124, and protrudes radially outwardly than an outer circumferential surface 144 of the head portion 72. In FIGS. 4 and 5, a clearance between an inner circumferential surface of the cylinder bore 12 and the outer circumferential surface 144 of the head portion 72 is exaggerated. As shown in FIG. 3, the rotation regulating portion 78 is integrally formed with the engagement portion 70 protruding radially outwardlly than the back surface 140 on the base end side, coupled by the coupling portion 124 on the side of the arm portion 120. The width of the rotation regulating portion 78 (a dimension in the tangent direction with respect to the inner circumferential surface of the front housing 16) is formed larger than the diameter of the head portion 72. Rotation regulating surfaces 146 are formed in two places isolatedly in the circumferential direction, on a surface that is a protruding surface of the rotation regulating portion 78 and opposes the inner circumferential surface of the front housing 16. The rotation regulating surfaces 146 form partially cylindrical surfaces defined by a center of curvature and a radius of curvature that are different from the outer circumferential surface 144 of the head portion 72. The radius of curvature of the rotation regulating surface 146 is made larger than that of the outer circumferential surface 144. Rotation of the piston 14 is regulated as described before by the rotation regulating portion 78 contacting the inner circumferential surface of the front housing 16 at a part of the rotation regulation surface 146 that is most distant from the central axis of the piston 14.

As shown in FIG. 2, in the cylinder block 10, an extension portion 150 is formed on a circumferential wall of each cylinder bore 12. The outer circumferential side part of the extension portion 150 distant from the central axis M axially extends longer toward the swash plate chamber 86 side than the inner circumferential side part close to the central axis M. A front end face 152 is defined by coupling each extension portion 150 mutually to be positioned on an identical plane, and the front housing 16 is attached on the front end face 152. The inner circumferential surface of the cylinder bore 12 has an inner circumferential surface 154 forming a complete cylindrical surface on the rear housing 18 side and an inner circumferential surface 156 forming a partially cylindrical surface on the front housing 16 side. An accommodation groove 160 extending axially is formed in the inner circumferential surface 156 of the cylinder bore 12, open to the front end surface 152, and extends to the midway of the inner circumferential surface 154. The accommodation groove 160 is formed as a rectangular groove with a width larger than the width of the axial rib 142 and smaller than the width of the inner circumferential surface 156. In addition, as shown in FIG. 5, a depth of the accommodation groove 160 to a bottom surface 162 is made a size that leaves a small clearance between the bottom surface 162 and an outer surface 166 of the axial rib 142 opposing the bottom surface 162. Further, in FIGS. 1 through 5, the sizes of the axial rib 142 and the accommodation groove 160 and the clearance between them are illustrated exaggeratedly for easier understanding. As described before, since rotation of the piston 14 around the central axis is regulated by the contact of the rotation regulating surface 146 of the rotation regulating portion 78 and the inner circumferential surface of the front housing 16, the side of the axial rib 142 and the side of the accommodation groove 160 do not contact, thus the clearance between them is secured and movement of the axial rib 142 in the accommodation groove 160 is not prevented.

According to the embodiment, bending strength of the coupling portion 124 can be larger and durability of the piston 14 can be improved while avoiding increase of the weight of the piston 14 as much as possible by the formation of the axial rib 142. Moreover, by forming in a part of the cylinder bore 12 the accommodation groove 160 that can accommodate the axial rib 142, interference between the axial rib 142 and the circumferential wall of the cylinder bore 12 can be avoided, when the piston 14 moves to the top dead center, without making the circumferential surface of the cylinder bore 12 larger in diameter. In addition, the sliding characteristics of the piston 14 can be improved. When the axial rib 142 is detached from the accommodation groove 160 at the last stage of suction stroke of the piston 14, lubricating oil existing in the swash plate chamber 86 in the form of mist or spray enters the accommodation groove 160. In the next compression stroke the axial rib 142 is inserted in the accommodation groove 160 again, and the lubricant oil in the accommodation groove 160 is supplied to the space between the inner circumferential surface 154 and the outer circumferential surface 144 of the head portion 72 in line with the decrease of the volume in the accommodation groove 160. Moreover, by increasing the length of the circumferential wall of the cylinder bore 12 on the distant side to the axis M with the extension portion 150, the fitting length of the piston 14 and the cylinder bore 12 at the bottom dead center of the piston 14 on the side can be made larger. Thus, since inclination of the piston 14 to the direction in which the engagement portion 70 moves radially outwardly can be well avoided, the non-returning of the piston 14 into the cylinder bore 12 due to excessive friction resistance, and an obstruction to return of the swash plate 60 to the minimum angle of inclination can be avoided. Further, since the extension portion 150 is not formed on the radially close side to the axis M, movement of the swash plate 60 from the maximum inclination position to the minimum inclination position is not prevented.

Figure 6:
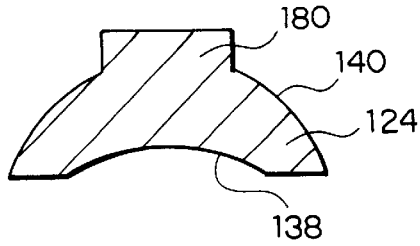
FIG. 6 is a side sectional view showing a coupling portion of a piston being another embodiment of the present invention.
Figure 7:
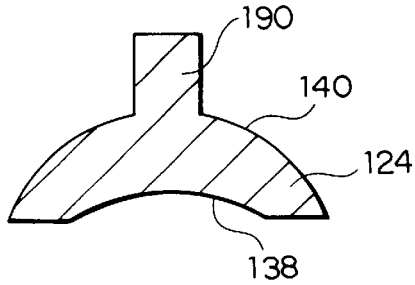
FIG. 7 is a side sectional view showing a coupling portion of a piston being further another embodiment of the present invention.
Figure 8:
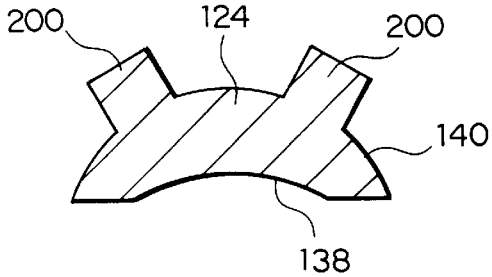
FIG. 8 is a side sectional view showing a coupling portion of a piston being further another embodiment of the present invention.
Figure 9:
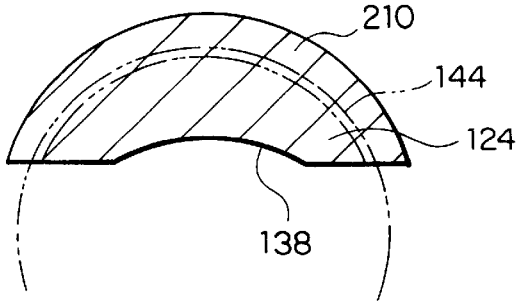
FIG. 9 is a side sectional view showing a coupling portion of a piston being further another embodiment of the present invention.
Figure 10:
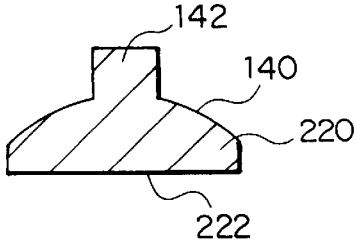
FIG. 10 is a side sectional view showing a coupling portion of a piston being further another embodiment of the present invention.

The axial rib 142 in this embodiment is an example of a protruding portion, and the protruding portion may take various forms and dimensions, and other number of protruding portions may be disposed. In addition, the accommodation groove 160 formed in the cylinder bore 12 is an example of an accommodation recess, a form of the accommodation recess may also be an appropriate one corresponding to a shape and a dimension of the protruding portion. For example, an axial rib as the protruding portion can be of various dimensions suitable for the dimension of the coupling portion 124, and, as shown in FIG. 6, may be an axial rib 180 with the dimension in the width direction of the coupling portion 124 larger than the dimension (height) in the radial direction. Conversely, as shown in FIG. 7, the axial rib may be an axial rib 190 with the dimension in the radial direction larger than the dimension in the width direction. The number of axial ribs to be disposed may be two other than one, and as shown in FIG. 8, two axial ribs 200 may be provided in positions apart from each other in the circumferential direction of the back surface 140. This is effective when it is difficult to form a rib in a central part in the width direction due to a structure of a piston. In addition, as shown in FIG. 9, a protruding portion 210 in a partially cylindrical shape may be formed which protrudes radially outwardly than the outer circumferential surface 144 of the head portion 72 over the entire outer circumference of the back surface 140 of the coupling portion 124. Moreover, as shown in FIG. 10, the present invention can be applied to a piston with an inner surface 222 of a coupling portion 220 forming a plane.

In the embodiments shown in FIGS. 1 through 5, the piston 14 is of the configuration in which neither the outer surface 166 of the axial rib 142 nor the back surface 140 of the coupling portion 124 is guided on the inner circumferential surface of the cylinder bore 12. However, the piston 14 may be configured such that the outer surface 166 is guided on the bottom surface 162 of the accommodation groove 160, or a part on the head portion 72 side of the back surface 140 of the coupling portion 124 is guided on the inner circumferential surface of the cylinder bore 12. In this way, since the piston 14 is guided not only on the outer circumferential surface 144 of the head portion 72 but also on the outer surface 166 or the back surface 140, the piston 14 can slide in the cylinder bore 12 more steadily.

The present invention may be applied to a piston of a configuration in which a closure member and an engagement portion are integrally formed and an opening of a bottomed cylindrical member forming a main part of a head portion is closed by the closure member, or a piston of a configuration in which a head portion is separated at the central part in the axial direction and has a portion provided with an engagement portion and a portion not provided with an engagement portion.

The present invention is applied to a variable capacity swash plate compressor. The weight of the pistons affects on the discharge capacity control of such a compressor, so it is effective to reduce the weight of the piston while reinforcing the piston. But the type of compressor is not limited.

A structure of a swash plate compressor is not limited to those in the above-mentioned embodiments, but may take other forms. For example, the capacity control valve 90 is not indispensable, and an operating valve can be provided which is mechanically opened and closed based on a difference between a pressure in the discharge chamber 24 and a pressure in the swash plate chamber 86. In addition, instead of the capacity control valve 90, or together with the capacity control valve 90, an electromagnetic control valve similar to the capacity control valve 90 may be provided in the midway of the bleeding passage 100, or an operating valve may be provided which is mechanically opened and closed based on a difference between a pressure in the swash plate chamber 86 and a pressure in the suction chamber 22.

The present invention may be applied to a double-headed piston having head portions on both sides of an engagement portion with a swash plate, or can be applied to a piston for a fixed capacity swash plate compressor.

Some embodiments of the present invention have been described in detail, but the embodiments are merely examples. The present invention may be implemented in a form in which various alterations or improvements are applied based on knowledge of those having ordinary skills in the art.

What is claimed is:

1. A piston for a swash plate compressor, comprising:

a head portion to be fitted in a cylinder bore; and an engagement portion, integrally formed with said head portion, which has a pair of arm portions and a coupling portion for coupling base ends of said arm portions to each other and engages with a swash plate while crossing over a circumference part of the swash plate, wherein said engagement portion is provided with a rotation regulating portion and a protruding portion, the protruding portion is separate from said rotation regulating portion and protrudes radially outwardly from a back surface on the opposite side of a swash plate side of the coupling portion.

2. A piston for a swash plate compressor according to claim 1, wherein the protruding portion may include an axial rib extending in a direction parallel to a central axis of said head portion on the back surface on the opposite side of the swash plate side of the coupling portion.

3. A piston for a swash plate compressor according to claim 2, wherein the number of the axial ribs is one, and the axial rib is provided in the center of the back surface of the coupling portion.

4. A piston for a swash plate compressor according to claim 2, wherein the number of the axial ribs is two, and the axial ribs are provided apart from each other extending on both sides of the center of the back surface of the coupling portion.

5. A piston for a swash plate compressor according to claim 2, wherein the number of axial ribs is one, and the axial rib is provided over the entire outer circumference of the back surface of the coupling portion.

6. A piston for a swash plate compressor according to claim 1, wherein an inner surface of the coupling portion forms a plane.

7. A swash plate compressor, comprising:

a piston according to claim 1;

a housing having a cylinder bore, said cylinder bore is fitted in said head portion of said piston, and forms an accommodating recess capable of accommodating the protruding portion on the inner circumferential surface; and a swash plate for reciprocatingly moving said piston by converting its rotational motion about a rotation axis into the reciprocating motion of the piston while engaging with said engagement portion and inclining with respect to the rotation axis.

8. A swash plate compressor according to claim 7, further comprising:

a swash plate driving device that supports said swash plate in a state in which an inclined angle of the swash plate with respect to the rotation axis is variable and rotates said swash plate;

an inclined angle control device for controlling the inclined angle of said swash plate by controlling a pressure in a swash plate chamber that is formed in said housing and accommodates said swash plate; and a biasing device for biasing said swash plate toward a position substantially perpendicular to the rotation axis, wherein three or more cylinder bores are provided around the rotation axis at an equal angular interval and said head portion of said piston is fitted in the respective cylinder bores, and wherein circumferential walls of the cylinder bores distant from the rotation axis is extended longer to the swash plate chamber side than circumferential walls of the cylinder bores close to the rotation axis, and accommodating recesses are formed at least in the extended walls.

9. A piston for a swash plate compressor, comprising:

a head portion to be fitted in a cylinder bore; and an engagement portion, integrally formed with said head portion, which has a pair of arm portions and a coupling portion for coupling base ends of said arm portions to each other and engages with a swash plate while crossing over a circumference part of the swash plate, wherein said engagement portion is provided with a protruding portion that protrudes radially outwardly from a back surface on the opposite side of a swash plate side of the coupling portion, said protruding portion is sized and configured to reciprocatingly move within a cylinder bore in a non-contacting manner during operation of a swash plate compressor.

10. A compressor, comprising:

a housing comprising a cylinder bore, said cylinder bore including a recess formed in an inner circumferential surface thereof;

a piston comprising:

a head portion to be fitted within said cylinder bore; and an engagement portion, integrally formed with said head portion, which has a pair of arm portions and a coupling portion for coupling base ends of said arm portions with each other, and which engages with a swash plate while crossing over a circumference part of the swash plate, wherein said engagement portion is provided with a protruding portion that protrudes radially outwardly, said protruding portion reciprocatingly moves within said recess; and a swash plate for reciprocatingly moving said piston by converting its rotational motion about a rotation axis into a reciprocating motion while engaging with said engagement portion and inclining with respect to the rotation axis.

* * * * *